US012298107B2

(12) United States Patent
Seyhun et al.

(10) Patent No.: US 12,298,107 B2
(45) Date of Patent: May 13, 2025

(54) SEMI-ACTIVE LASER SEEKER FOR MINIATURE, LASER-GUIDED MISSILE SYSTEMS

(71) Applicant: ROKETSAN ROKET SANAYii TiCARET A. Ş., Ankara (TR)

(72) Inventors: Selçuk Seyhun, Ankara (TR); Berk Bolat, Ankara (TR)

(73) Assignee: ROKETSAN ROKET SANAYII TICARET A. S., Ankara (TR)

( * ) Notice: Subject to any disclaimer, the term of this patent is extended or adjusted under 35 U.S.C. 154(b) by 0 days.

(21) Appl. No.: 18/008,901

(22) PCT Filed: Jun. 7, 2021

(86) PCT No.: PCT/TR2021/050542
§ 371 (c)(1),
(2) Date: Dec. 7, 2022

(87) PCT Pub. No.: WO2021/251929
PCT Pub. Date: Dec. 16, 2021

(65) Prior Publication Data
US 2023/0213314 A1 Jul. 6, 2023

(51) Int. Cl.
*F41G 7/22* (2006.01)

(52) U.S. Cl.
CPC ..... *F41G 7/226* (2013.01); *F41G 7/2226* (2013.01); *F41G 7/2293* (2013.01)

(58) Field of Classification Search
CPC ..... F41G 7/226; F41G 7/2226; F41G 7/2293
See application file for complete search history.

(56) References Cited

U.S. PATENT DOCUMENTS 3,841,585 A * 10/1974 Evers-Euterneck .... F41G 7/226 244/3.17
4,381,090 A * 4/1983 Garner ..... F41G 7/2293 244/3.16
4,701,602 A * 10/1987 Schaefer ..... G02B 27/644 356/139.08
5,307,077 A 4/1994 Branigan et al.
5,456,179 A * 10/1995 Lamelot ..... F41G 7/2293 102/213

(Continued)

FOREIGN PATENT DOCUMENTS

WO 2012005781 1/2012

*Primary Examiner* — Bernarr E Gregory
(74) *Attorney, Agent, or Firm* — Crose Law LLC; Bradley D. Crose

(57) ABSTRACT

The present invention relates to a semi-active laser seeker head for miniature, laser-guided missile systems comprising a housing (20) limiting an inner chamber (23); a lens element (40) that is seated in a gap (26) of the housing (20) reaching the inner chamber (23) so as to receive electromagnetic radiation. The laser seeker head comprises; a body (44) that has a convex surface (42) on which the lens element (40) gets completely seated in a gap (26) on one hand and that extends into the inner chamber (23) on the other hand; and a filter (52) that directly receives the electromagnetic radiation, which is focused by the convex surface (42), from the body (44) that lies before and selectively transfers it to a multi-channel sensor (56) arranged at the rear portion thereof based on a predetermined wavelength threshold.

13 Claims, 3 Drawing Sheets

(56) References Cited

U.S. PATENT DOCUMENTS

| | | | | |
|---|---|---|---|---|
| 5,458,298 | A * | 10/1995 | Lamelot | G01S 3/789 244/3.16 |
| 7,714,989 | B1 * | 5/2010 | Freeman | F41G 7/226 356/29 |
| 2011/0017864 | A1 * | 1/2011 | Roemerman | F41G 7/226 244/3.16 |
| 2012/0193538 | A1 * | 8/2012 | Roncone | F41G 7/226 250/353 |
| 2012/0218628 | A1 * | 8/2012 | Egbert | F41G 7/226 359/356 |
| 2015/0369918 | A1 * | 12/2015 | Tacke | G01S 7/4863 702/150 |
| 2017/0205198 | A1 | 7/2017 | Roncone et al. | |

* cited by examiner

SEMI-ACTIVE LASER SEEKER FOR MINIATURE, LASER-GUIDED MISSILE SYSTEMS

TECHNICAL FIELD OF THE INVENTION

The present invention relates to seeker heads, and particularly to, seeker heads for miniature, laser-guided missiles.

STATE OF THE ART

In laser-guided missile systems, designation of a target's location is performed by means of a laser seeker head section. This section has an optical imaging system comprising lenses, optical filter, sensor, and electronic circuit board, and a mechanical body and connection elements for adaption to the missile body. A target that is marked by the laser is designated by the seeker head, a course is set towards the target by means of the control actuation system driven by the flight controller of the rocket, and the target is destroyed in arrival or approach conditions. Generally, the optical imaging system is mounted on a part that is suspended on a gimbal located on the seeker head. The optical imaging system creates a field of view in the axis of a suitably patterned reticle. A fixed rocket detector is located behind the reticle and subjected to reflections of the field of view. Parts suspended on the gimbal essentially rotate at a high angular speed on an axis at the longitudinal direction of the rocket and thus, create a gyroscope that is largely independent of rocket movements with optical system components thereof. Another seeker scans the field of view on a pointwise basis by means of the oscillator mirror in combination with scanning photoelectric sensors consisting of a number of detectors and a target off-course signal created from the information obtained. Target off-course signal aligns the seeker with the target and separates the seeker from movements of the missile by means of the gimbal suspension.

The publication numbered US2017205198A1 discloses a dual-band semi-active laser (SAL) seeker sensing system with a dual-band filter. According to an example of the above-mentioned invention, a semi-active laser sensing system comprises a detector assembly and an aperture lens. The SAL sensing system further comprises a dual-band filter having a stopband, a first passband, and a second passband, the first and second passbands being distinct and non-overlapping and spectrally separated from one another by a portion of the stopband, the filter being configured to receive the electromagnetic radiation from the aperture lens and to filter the electromagnetic radiation to pass a first wavelength range within the first passband and a second wavelength range within the second passband. The SAL sensing system further comprises a lens assembly configured to receive the first and second wavelength ranges from the filter and to focus the first and second wavelength ranges onto the detector assembly.

BRIEF DESCRIPTION OF THE INVENTION

The object of the present invention is to provide a compact semi-active laser seeker head for a present miniature missile.

The present invention, for the purpose of achieving the aforementioned object, comprises; a semi-active laser seeker head for a miniature laser-guided missile system, wherein said semi-active laser seeker head comprises a housing that limits an inner chamber; a laser permeable that is seated in housing's gap that reaches the inner chamber so as to receive electromagnetic radiation, and preferably a transparent lens element. The laser seeker head further comprises; a body that has a convex surface on which the lens element gets completely seated in a gap on one hand and that extends into the inner chamber on the other hand; and a filter that directly receives the electromagnetic radiation, which is focused by said convex surface, from the body that lies before and selectively transfers it to a multi-channel sensor arranged at the rear portion thereof based on a predetermined wavelength threshold. The cambered exterior surface of the lens element is configured to receive electromagnetic radiation, for example, a pulsed laser signal, inside the inner chamber and it focuses the same towards the filter behind. Thus, the use of a plurality of lens elements is avoided. For example, a very compact optical imaging system is obtained by means of the one-piece lens element that focuses directly by its convex surface facing outwards and then transmits it directly from behind to the filter in case the inner chamber is not sufficient for more than one lens element in a miniature missile having a size of 40 mm or less. The filter is preferably configured such that a wavelength of 1064 nm may permeate therethrough In a preferred embodiment of the present invention, the convex surface is seated in an airtight manner so as to complete the gap in the middle center of a front wall of the housing to a form of a dome. In this case, the lens element forms the outer portion of the miniature missile without damaging its aerodynamic structure and may be seated in front of a miniature missile as a dome-shaped head.

A preferred embodiment of the present invention comprises a mounting plate that lies transversely in the inner chamber in which the multi-channel sensor is positioned adjacent to the rear edge of the body together with the filter. The transverse mounting plate allows for positioning the multi-channel sensor inside the inner chamber such that it faces the lens element and that it occupies the least amount of space inside the inner chamber.

In a preferred embodiment of the invention, the lens element is composed of a material having a high refractive index of 1.50 or more, and especially ceramic. A high refraction index ensures that the lens element may be utilized individually and that it occupies less space inside the inner chamber. Preferably, the lens element may be made of materials such as glass, zinc sulfide, borosilicate, and polyetherimide.

A preferred embodiment of the present invention comprises a signal amplifier that is connected to the multi-channel sensor to provide signal transmission and is configured to amplify the electromagnetic radiation signal obtained by the multi-channel sensor. This allows for amplifying the weak signal values generated by the weak electromagnetic radiation received from the single lens element, and thus, utilizing a single lens.

A preferred embodiment of the present invention comprises a gain controller having a multi-channel amplifier connected to the signal amplifier so as to provide signal transmission and is configured to selectively and separately amplify the electromagnetic radiation signal received from each channel of the multi-channel sensor. Selectively amplifying the signal value of each channel ensures energy saving by means of selectively and separately amplifying the signal of each channel when required.

A preferred embodiment of the present invention comprises an adder circuit arranged to determine the total signal value received from each channel by means of connecting with the multi-channel amplifier so as to provide signal transmission, and a central controller that activates a single-channel A/D element to which it is connected, and compares it so as to identify the numerically largest signal in the sensed pulsed signal train as the target source, in case the value of total signal provided from the adder circuit exceeds a threshold value. The central controller allows for examining the total signal value so as to designate the presence of a laser-marked target. The central controller may perform target designation by means of comparing the numerical values and selecting the signal having the highest value in case pulsed laser signal includes scatterings.

A preferred embodiment of the present invention comprises a trigger circuit provided to conduct electrical signals between the adder circuit and the central controller, and that arranged so as to send a pulse monitoring signal that activates the single-channel A/D element to the central controller in case of excess by means of comparing the threshold value with the total signal value received from the adder circuit. The trigger circuit prevents using energy by means of that the central controller performs continuously monitoring. Thus, said trigger circuit ensures that the central processor uses signal processing only in suspicious cases by consuming less energy and that the central processor consumes a minimum amount of energy in other cases.

A preferred embodiment of the present invention comprises a multi-channel A/D element in which the central controller is connected such that it conducts electrical signal, and is configured so as to activate said central controller such that the data received by the multi-channel sensor are individually digitized and transferred to the central controller when a pulse monitoring signal sent by the trigger circuit is received by the central controller and at the moment the quantitively largest pulse is observed. The location information may be determined in cases of the target is designated by a multi-channel A/D element. The pulsed signal train reflected each channel is evaluated separately due to the laser marking of the target.

In a preferred embodiment of the present invention, the central controller has been configured so as to determine the laser pulse sensed from the digitized data received from the multi-channel A/D element by means of calculating the normalized orientations of the laser pulse with respect to the seeker head axis. Thus, for example, each segment of the quadrant of the multi-channel sensor divided into a biaxial structure provides separate signal data thereby, it is possible to determine the target coordinates of the central controller. The patent document numbered US2017205198A1 discloses the missile target designation by means of such a multi-channel sensor.

In a preferred embodiment of the present invention, the central controller is configured so as to increase the gain level of the multi-channel amplifier to a predetermined level in case the total signal value provided from the adder circuit remains under a predetermined threshold value. Thus, the consumed energy is increased gradually only when the signal is not determined, and the system is enabled to operate with the least possible consumption value.

In a preferred embodiment of the present invention, the central controller is configured so as to adjust the gain level of the multi-channel amplifier to the highest value provided by the multi-channel amplifier in case the total signal value provided from the adder circuit remains under the predetermined threshold value. In that case, the maximum sensitivity has been obtained by means of the highest gain value.

In a preferred embodiment of the present invention multi-channel sensor comprises four identical quadrant structures divided symmetrically to one another. Therefore, the designation of a target gets easier by means of the above-mentioned structure. A preferred embodiment is a miniature missile comprising a laser seeker head according to any one of the embodiments described above.

DETAILED DESCRIPTION OF THE INVENTION

In the detailed description provided herein, the inventive innovation is described only to provide a better understanding of the subject matter by examples and references and without constituting any limiting effect.

Figure 1:
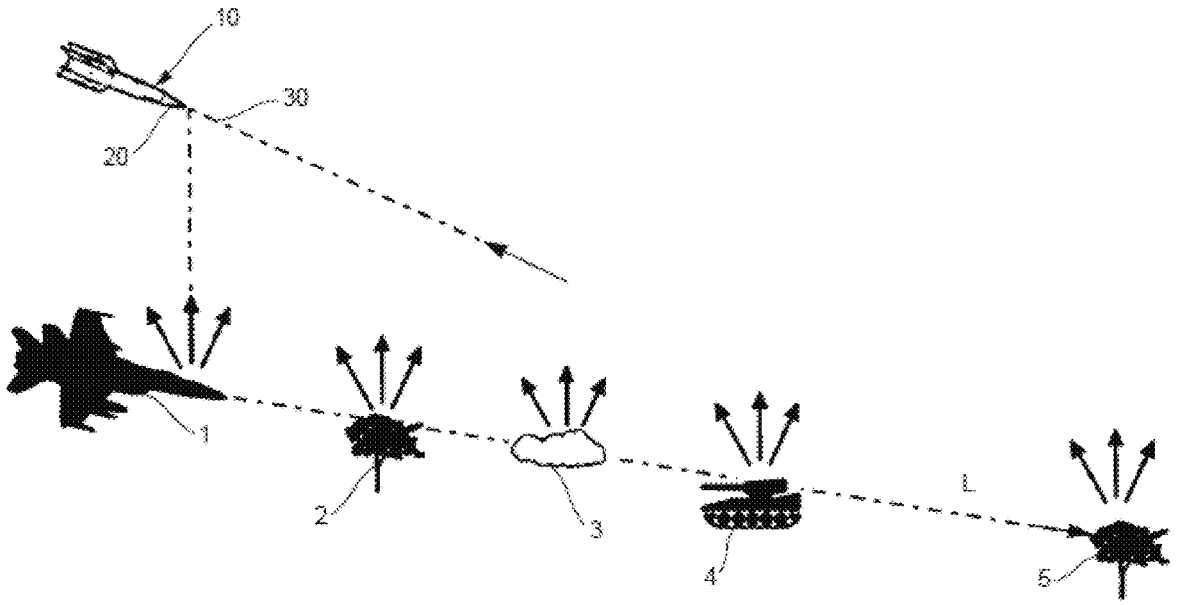
FIG. 1 illustrates the schematic view of the scattering of the laser shooting from the target and other environmental elements provided from a source for a laser seeker head owned by a miniature missile.

FIG. 1 representationally illustrates a 40 mm miniature missile (10) aimed at a target (4). The laser seeker head is a subsystem that notifies the location of the target (4) to the laser-guided miniature missile (10) by means of sensing the reflected radiation from the target (4) marked by a laser designator (1) as a successive great number of pulsed signal trains (30). The laser designator (1) senses more than one reverse reflection in most shooting scenarios. Said reverse reflections consist of scatterings at the moment of the beam exit from the laser designator (1), natural or artificial external obstacles (2) to which part of the laser touched in the line of marking, water vapor forming atmospheric obstacles (3), scatterings caused by smoke and density, and the rebound of the laser (L) flooding from the edges of the marked target (4) from the further rear obstacles (5).

Figure 2:
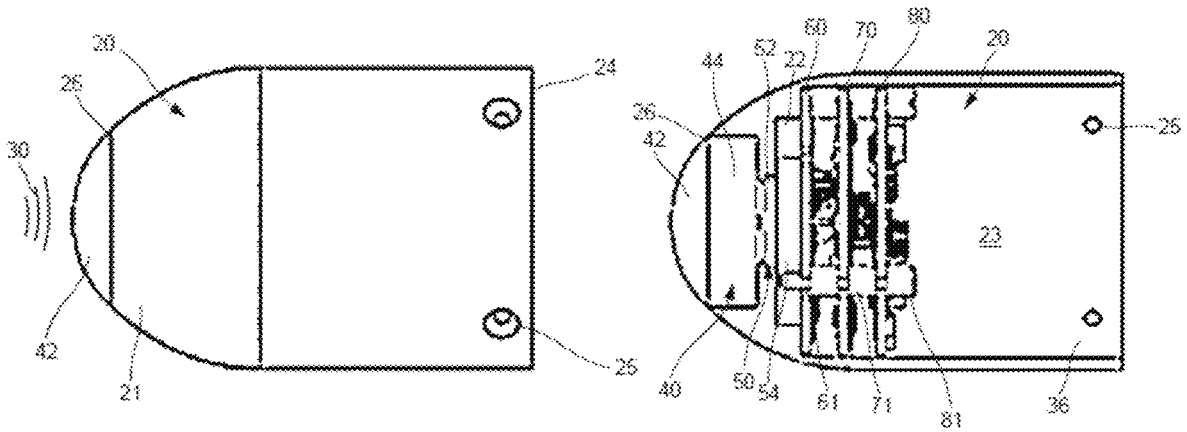
FIG. 2 illustrates the outer view and the cross-sectional view of a representational embodiment of the inventive laser seeker for the inventive miniature guided missile in assembled state.

FIG. 2 illustrates both the outer view and the cross-sectional view of the inventive semi-active laser seeker head used in the miniature missile (10). The laser seeker head comprises a housing (20) having a cylindrical form with a dome-shaped end surrounding an empty inner chamber (23) so as to form an end portion of the miniature missile (10). A flat rare edge (24) of the housing (20) is formed a mouth that may be accessed externally to the cavity created by the inner chamber (23) when the housing (20) is disassembled. There are mounting recesses (25) in the structure of holes distanced from one another on the rear edge (24). The mounting recesses (25) assist that the housing (20) is mounted on the body of the miniature missile (10). A front wall (21) of the housing (20) opposite the rear edge (24) has the structure of a dome in which a circular gap (26) with a cut-off end accessible to the inner chamber (23) is situated. A lens element (40) is produced from a ceramic material having a solid and high refractive light-permeable index as one piece. The front end of the lens element (40) comprises a convex surface (42). The convex surface (42) circumferentially and completely engages the gap (26) in an airtight manner. The rear part of the convex surface (42) forms a cylindrically continuing body (44). A laser pulsed signal train (30) moves from within the body (44) by highly refracting from the gap (26) by means of convex surface (42). A sensing assembly (50) is provided in the inner chamber (23) at the rear part of the body (44). In sensing assembly (50), a circular filter (52) has been fixed transversely in the inner chamber by means of a mounting plate (54) so as to fall on the image focused by the convex surface (42) behind the body (44). A signal amplifier (60), a gain controller (70), and an electronic control unit (80), each one of them has a structure of an integrated and coaxial board, extend transversely in an adjacent order in the inner chamber (23) along the circumferential edges, distantly separated from each other by means of one each mounting pin (61, 71, 81). Thus, a very compact controlling system is fitted into the housing (20) of the inner chamber (23) at the front part of the 40 mm miniature missile.

Figure 3:
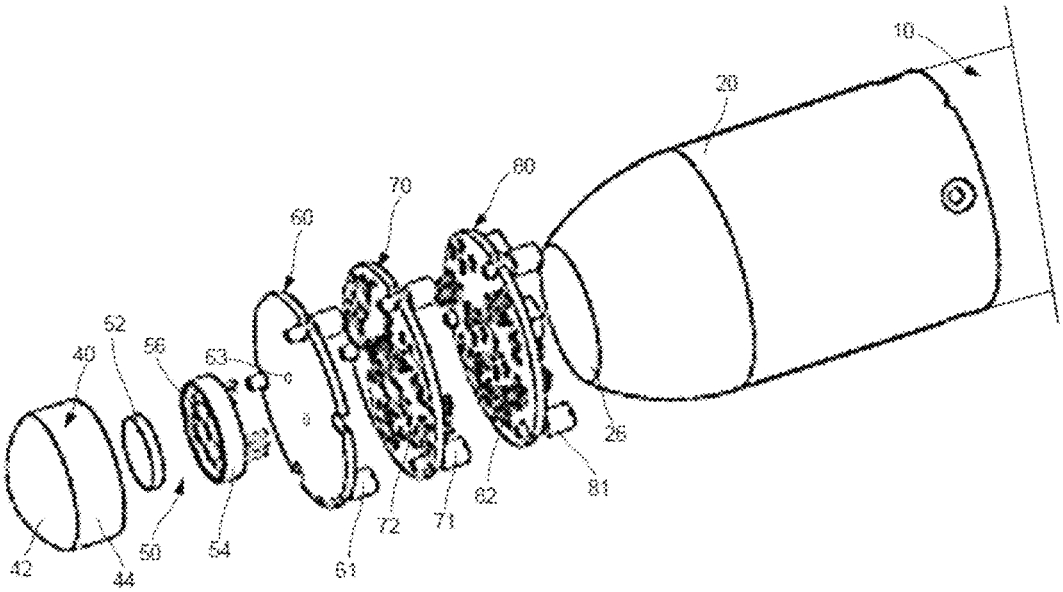
FIG. 3 illustrates the perspective view of the embodiment shown in FIG. 2 in a disassembled state.

FIG. 3 illustrates the perspective view of components in a disassembled state in the inner chamber (23). There is a multi-channel sensor (56) having a quadrant divided into four segments in a plus shape behind the circular filter (52), on the side of the mounting plate (54) facing the filter (52). The filter (52) is seated coaxially such that it directly and completely covers the circular multi-channel sensor (56).

Thus, filter (52) seats on the flat and circular rear face of the body (44) from one front face, and on the multi-channel sensor (56) from its rear face. The pins of the multi-channel sensor (56) of the sensing assembly (50) are located on the rear face of the mounting plate (54). Pins run through the corresponding slots (63), which have a hole structure from one end to the other and reach the signal amplifier (60) that has a circular, coaxial plate structure. The signal amplifier (60) is connected with the multi-channel sensor (56) so as to provide analog signal transmission. The signal amplifier (60) includes an amplifier circuit (62) on its rear face and is seated from the rear at a distance from a gain controller (70) having a circular coaxial board structure. The gain controller (70) carries a multi-channel amplifier (72) thereon. An electronic control unit (80) with the structure of an integrated board having a central processor is leaned on the gain controller (70) from the rear at a distance.

Figure 4:
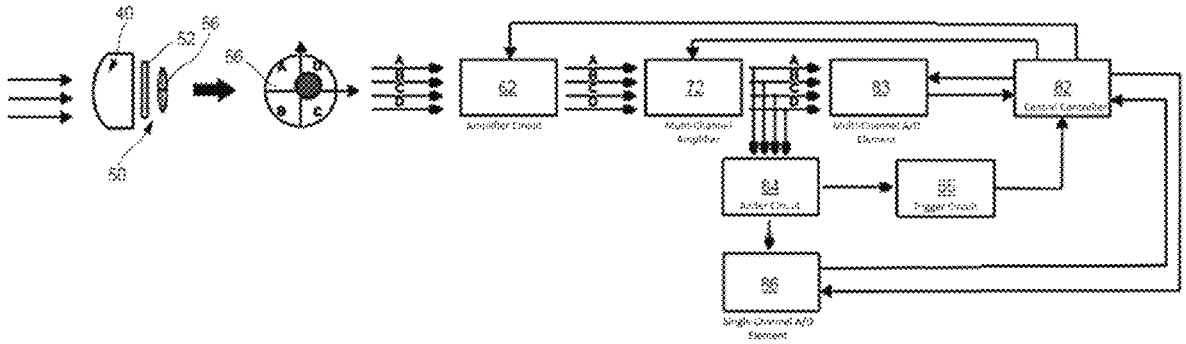
FIG. 4 illustrates the schematic view of a representational embodiment of the operating system of the laser seeker head.

FIG. 4 illustrates an operation scheme of the seeker head. The seeker head has two A/D (the expression of Analog to Digital is referred to as A/D) converters. One of said converters is a fast single-channel A/D element (86) that digitizes the total signal (Ts) obtained from all of the channels of the multi-channel sensor (56) having four quadrants, and the other one is a multi-channel A/D element that separately digitizes the signals receiving from the 4 channels. Fast A/D may digitize separate laser pulses received at a frequency of 1 ρs. The slow multi-channel A/D element separately digitizes the outputs of all channels within 100 ρs, and data to be utilized in order to calculate the angular location of the target (4) in accordance with the miniature missile (10) axis is obtained by means of using said data.

Figure 5:
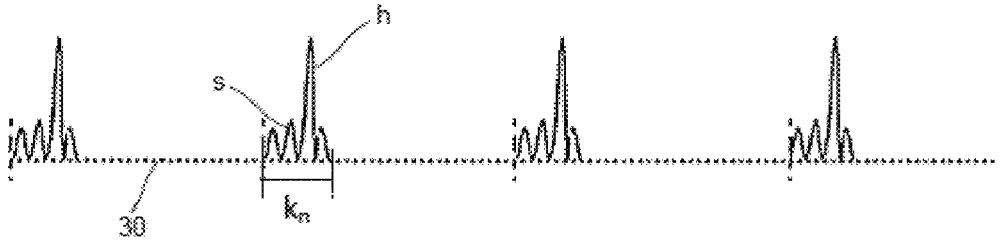
FIG. 5 illustrates the graphical view of the pulsed signal train arriving at the laser seeker head from the laser source.

The central controller (82) owned by the electronic control unit (80) on the munition records the intensities of laser pulsed signal trains (30) at a frequency of 1 ρs received from the fast single-channel A/D element (86) and the time difference between them. It assumes that the target (4) always has the highest reflection signal intensity. Laser designators (1) send laser pulses at fixed intervals and the frequency of the pulses sent by said laser designators (1) never exceeds 20 Hz. This means that there is a huge time difference between the pulsed signal trains composed of reflection and scattering. FIG. 5 illustrates the schematic view of the said situation. The lateral and ascending angular positions of the signal having the highest intensity in said pulsed signal trains (30) are calculated by the central controller (82) in accordance with the direction of the miniature missile (10) by means of using the data obtained from the multi-channel A/D element (83). Thus, it is ensured that the seeker head produces information that directs the munition to the correct target (4).

The working principle of the laser seeker head is as follows; Laser pulses exiting from the laser designator (1) and reflecting from the target (4) reach the seeker lens element (40). Additionally, they are optically filtered by the filter (52) in which they reached from the body (44) by focusing on the convex surface (42) over the lens element (40) together with the second laser pulses originates due to the reasons such as scattering and reflection, and they are sensed by means of the multi-channel sensor (56) having four equal segments which have first, second, third and fourth channels (A, B, C, D), respectively. The signals exit from the 4 segments (A, B, C, D) of the multi-channel sensor (56) pass through the front amplifier circuit (62) acting as a preamplifier, and multi-channel amplifier (72) that is variably gainful, respectively, then reach an adder circuit (84) for 4 channels. Herein, 4 channel (A, B, C, D) signals are turned into TS total signal. TS is sent to a trigger circuit (85). The trigger circuit (85) generates a laser pulse observation signal and transmits it to the central controller (82) in case the TS signal is higher than a certain threshold level. The central controller (82) is configured so as to examine the magnitude of the laser pulses sensed over the fast single-channel A/D element (86). Laser pulse signal train (30) decides the quantitatively largest signal inside is the target (4) and operates multi-channel A/D element (83) in order to individually digitize the segment data of multi-channel sensor (56) at the moment of the large pulse is observed. The electronic control unit (80) finds the normalized orientations of the sensed laser pulse with respect to the seeker head axis, that is, to miniature missile (10) extension axis by means of using the received data.

In case there is no sensed signal, the front signal amplifier (60) gets activated. Again, in case there is no sensed signal, the gain level is increased by means of utilizing the central controller (82) which is a variable gain amplifier, and also a multi-channel amplifier (72) until the signal is sensed. It remains in a standby state at the highest gain level until the signal is sensed if still no signal is sensed. They are utilized through the signal amplifier (60), which is the pre-amplifier, and the central controller (82), which is a variable gain amplifier.

| REFERENCE NUMERALS | |
|---|---|
| 1 | Laser Designator |
| 2 | External Obstacle |
| 3 | Atmospheric Obstacle |
| 4 | Target |
| 5 | Rear Obstacle |
| 10 | Miniature Missile |
| 20 | Housing |
| 21 | Front Wall |
| 23 | Inner Chamber |
| 24 | Rear Edge |
| 25 | Mounting Recess |
| 26 | Gap |
| 30 | Pulsed Signal Train |
| 40 | Lens Element |
| 42 | Convex Surface |
| 44 | Body |
| 50 | Sensing Assembly |
| 52 | Filter |

-continued

| REFERENCE NUMERALS | |
|---|---|
| 54 | Mounting Plate |
| 56 | Multi-Channel Sensor |
| 60 | Signal Amplifier |
| 61 | Connecting Pin |
| 62 | Amplifier Circuit |
| 63 | Slot |
| 70 | Gain Controller |
| 71 | Connecting Pin |
| 72 | Multi-Channel Amplifier |
| 80 | Electronic Control Unit |
| 81 | Connecting Pin |
| 82 | Central Controller |
| 83 | Multi-Channel A/D Element |
| 84 | Adder Circuit |
| 85 | Trigger Circuit |
| 86 | Single-Channel A/D Element |
| A | First Channel |
| B | Second Channel |
| C | Third Channel |
| D | Fourth Channel |
| L | Laser Mark |

The invention claimed is:

1. A semi-active laser seeker head for miniature, laser-guided missile systems comprising a housing (20) limiting an inner chamber (23); a laser-permeable, a transparent lens element (40) that is seated in a gap (26) of the housing (20) reaching the inner chamber (23) so as to receive electromagnetic radiation, characterized in that, the laser seeker head comprises; a body (44) that has a convex surface (42) on which the lens element (40) is completely seated in the gap (26) on one hand and that extends into the inner chamber (23) on the other hand; and a filter (52) that directly receives the electromagnetic radiation, which is focused by said convex surface (42), from the body (44) that lies before and selectively transfers the electromagnetic radiation to a multi-channel sensor (56) arranged at the rear portion thereof based on a predetermined wavelength threshold.

2. A laser seeker head according to claim 1, characterized in that, the convex surface (42) is seated in an airtight manner such that the convex surface (42) completes the gap (26) at the middle center of a front wall (21) of the housing (20) so as to a form of a dome.

3. A laser seeker head according to claim 1, characterized in that, multi-channel sensor (56) comprises a mounting plate (54) that extends transversely in the inner chamber (23) in which the multi-channel sensor is positioned adjacent to the rear edge of the body (44) together with the filter (52).

4. A laser seeker head according to claim 1, characterized in that, the laser seeker head comprises; a signal amplifier (60) that is connected to the multi-channel sensor (56) to provide signal transmission and is configured to amplify the electromagnetic radiation signal obtained by the multi-channel sensor (56).

5. A laser seeker head according to claim 4, characterized in that, the laser seeker head comprises; a gain controller (70) having a multi-channel amplifier (72) that is connected to the signal amplifier (60) so as to provide signal transmission and that is configured to selectively and separately amplify the electromagnetic radiation signal received from each channel of the multi-channel sensor (50).

6. A laser seeker head according to claim 5, characterized in that, the laser seeker head comprises; an adder circuit (84) arranged to determine the total signal value received from each channel by means of connecting with the multi-channel amplifier (72) so as to provide signal transmission, and a central controller (82) that activates a single-channel analog-to-digital (A/D) element (86) to which central controller (82) is connected, and compares it so as to identify the numerically largest signal in the sensed pulsed signal train (30) as the target source, in case the value of total signal provided from the adder circuit (84) exceeds a threshold value.

7. A laser seeker head according to claim 6, characterized in that, the laser seeker head comprises; a trigger circuit (85) that is provided to conduct electrical signals between the adder circuit (84) and the central controller (82), and that is arranged so as to send a pulse monitoring signal that activates the single-channel analog-to-digital (A/D) element (86) to the central controller (82) in case of excess by means of comparing the threshold value with the total signal value received from the adder circuit (84).

8. A laser seeker head according to claim 7, characterized in that, the laser seeker head comprises; a multi-channel analog-to-digital (A/D) element (83) in which the central controller (82) is connected such that the central controller (82) conducts electrical signal, and is configured so as to activate said central controller (82) such that the data received by the multi-channel sensor (56) are individually digitized and transferred to the central controller (82) when a pulse monitoring signal sent by the trigger circuit (85) is received by the central controller (82) and at the moment the quantitatively largest pulse is observed.

9. A laser seeker head according to claim 8, characterized in that, the central controller (82) is configured to determine the laser pulse sensed from the digitized data received from the multi-channel analog-to-digital (A/D) element (83) by means of calculating the normalized orientations of the laser pulse with respect to the seeker head axis.

10. A laser seeker head according to claim 7, characterized in that, the central controller (82) is configured so as to increase the gain level of the multi-channel amplifier (72) to a predetermined level in case the total signal value provided from the adder circuit (84) remains under the predetermined threshold value.

11. A laser seeker head according to claim 7, characterized in that, the central controller (82) is configured so as to adjust the gain level of the multi-channel amplifier (72) to the highest value provided by the multi-channel amplifier (72) in case the total signal value provided from adder circuit (84) remains under the predetermined threshold value.

12. A laser seeker head according to claim 1, characterized in that, the multi-channel sensor (56) comprises four identical quadrant structures divided symmetrically to one another.

13. A miniature missile (10) comprising a laser seeker head according to claim 1.

* * * * *